US008938930B2

(12) United States Patent
Bryant, Jr. et al.

(10) Patent No.: US 8,938,930 B2
(45) Date of Patent: Jan. 27, 2015

(54) SUPPORT APPARATUS FOR WELLBORE TOOLS

(71) Applicants: Charles Larue Bryant, Jr., Harvey, LA (US); David J. Ruttley, Harvey, LA (US)

(72) Inventors: Charles Larue Bryant, Jr., Harvey, LA (US); David J. Ruttley, Harvey, LA (US)

( * ) Notice: Subject to any disclaimer, the term of this patent is extended or adjusted under 35 U.S.C. 154(b) by 0 days.

(21) Appl. No.: 13/935,737

(22) Filed: Jul. 5, 2013

(65) Prior Publication Data

US 2013/0291475 A1 Nov. 7, 2013

Related U.S. Application Data

(63) Continuation of application No. 13/200,136, filed on Dec. 12, 2011, now abandoned.

(51) Int. Cl.

| | |
|---|---|
| ***E04H 12/00*** | (2006.01) |
| ***E21B 15/00*** | (2006.01) |
| ***E21B 7/02*** | (2006.01) |
| *E21B 29/00* | (2006.01) |
| *E21B 19/08* | (2006.01) |

(52) U.S. Cl.

CPC ..... *E21B 15/00* (2013.01); *E21B 7/023* (2013.01); *E21B 15/003* (2013.01); *E21B 29/00* (2013.01); *E21B 19/08* (2013.01)

USPC ..... 52/650.3; 52/111; 166/349; 166/352; 166/77.51

(58) Field of Classification Search

USPC ..... 52/64, 67, 79.1, 111, 650.3, 651.05; 166/348, 349, 351, 352, 358, 77.51, 166/85.1, 75.14; 405/196, 224.2

See application file for complete search history.

(56) References Cited

U.S. PATENT DOCUMENTS

| | | | | |
|---|---|---|---|---|
| 3,515,084 | A * | 6/1970 | Holmes | 114/122 |
| 3,664,437 | A * | 5/1972 | McCulloch | 175/5 |
| 3,877,529 | A * | 4/1975 | Litchfield | 175/65 |
| 3,902,553 | A * | 9/1975 | Jergins | 166/352 |
| 4,147,215 | A * | 4/1979 | Hodge et al. | 166/380 |
| 4,208,158 | A * | 6/1980 | Davies et al. | 414/22.68 |
| 4,643,259 | A * | 2/1987 | Zeringue, Jr. | 166/77.51 |
| 4,843,945 | A * | 7/1989 | Dinsdale | 81/57.34 |
| 5,467,833 | A * | 11/1995 | Crain | 175/52 |
| 5,954,305 | A * | 9/1999 | Calabro | 248/219.4 |
| 6,715,569 | B1 * | 4/2004 | Rogers | 175/85 |
| 6,929,071 | B2 * | 8/2005 | Moncus et al. | 166/355 |
| 7,527,100 | B2 * | 5/2009 | Abadie | 166/298 |
| 7,665,533 | B2 * | 2/2010 | Hopwood et al. | 166/380 |
| 2003/0155154 | A1 * | 8/2003 | Oser | 175/52 |
| 2005/0223933 | A1 * | 10/2005 | Crosbie et al. | 104/31 |
| 2007/0144745 | A1 * | 6/2007 | Carriere et al. | 166/379 |
| 2011/0005768 | A1 * | 1/2011 | Coles | 166/355 |

* cited by examiner

*Primary Examiner* — Brian Glessner
*Assistant Examiner* — Brian D Mattei
(74) *Attorney, Agent, or Firm* — Ted M. Anthony

(57) ABSTRACT

An apparatus for supporting tubular goods and wellbore tools that can be used to perform down-hole operations in oil and gas wells. The support apparatus has a minimal footprint and requires minimal surface area. The support apparatus can be used to jack and remove casing and other pipe, as well as other rig-less downhole well operations.

6 Claims, 14 Drawing Sheets

SUPPORT APPARATUS FOR WELLBORE TOOLS

CROSS REFERENCES TO RELATED APPLICATIONS

Priority of U.S. Non-provisional patent application Ser. No. 13/200,136, Filed Dec. 12, 2011, Incorporated Herein by Reference, is Hereby Claimed.

STATEMENTS AS TO RIGHTS TO INVENTIONS MADE UNDER FEDERALLY SPONSORED RESEARCH AND DEVELOPMENT

None

BACKGROUND OF THE INVENTION

1. Field of the Invention

The present invention relates to a system for use with wells drilled into the earth's crust. More particularly, the present invention relates to a support apparatus for conducting down-hole operations in wells including, without limitation, cutting underwater casing strings and retrieving tubular goods from wells.

2. Description of the Prior Art

Oil and gas wells are typically drilled using drilling rigs or other similar devices to create substantially cylindrical boreholes that extend downward into the earth's crust. After a well has been drilled to a desired depth, large diameter pipe commonly referred to as casing is frequently installed into the well and cemented in place. Thereafter, production tubing is often run into the well, concentrically inside the casing, in order to provide a conduit for the flow of oil and/or gas production from an underground reservoir to the earth's surface.

It is often necessary to conduct downhole operations within a well for any number of reasons including, without limitation, remedial or repair work. In such instances, it is often beneficial to insert tubular goods and bottom-hole assemblies into said well, manipulate (for example, rotate or reciprocate) said tubular goods and bottom-hole assemblies within said well, and/or remove tubular goods and other equipment from said well.

In order to perform such downhole well operations, it is frequently necessary to provide a surface structure for supporting equipment and personnel. Although conventional drilling rigs can generally be used for this purpose, the expense associated with mobilization, demobilization and operation of conventional rigs can be cost prohibitive especially for relatively small operations. Further, space limitations can sometimes prohibit the use of certain larger drilling or workover rigs. Thus, there is a need for a surface support structure that provides some or all of the operational benefits of conventional rigs, such as the ability to rotate tubular goods and lift such tubular goods in and out of a well.

One common downhole operation involves the plugging and abandonment of depleted wells. After hydrocarbon reserves in a well have been fully recovered, the well must eventually be plugged and abandoned and the well site restored to its original condition. Generally, surface equipment must first be removed from a depleted well. Thereafter, as much production tubing and casing as possible is typically retrieved from a well; in many cases, such recovered tubular goods can be reused in other wells or sold for salvage. However, because the pipe—and especially the casing—can be cemented or otherwise secured in place, blades or other cutting devices are frequently needed to cut the pipe at a desired depth in the well prior to removal. In many cases, such cutting equipment is conveyed in and out of a well via tubular workstring. After desired down-hole cut(s) are made, the workstring and the severed pipe are typically pulled out of the well from the surface.

Such plugging and abandonment operations can be expensive, especially when performed using conventional rigs. When conventional rigs are used, such rigs and related equipment must be mobilized to a location prior to commencing work, and demobilized after such work is completed. Even when conventional rigs are not utilized, such plugging and abandonment operations typically require the use of valuable offshore rig space, operation of pedestal cranes and/or other platform-mounted equipment.

Thus, there is a need for an apparatus that eliminates many of the problems associated with conventional well operation techniques including, but not necessarily limited to, plugging and abandonment operations. Such apparatus should support wellbore tubular goods and related equipment that can be used to conduct down-hole operations in oil and gas wells, while requiring minimal surface area (e.g., deck space) and providing many of the operational benefits of conventional drilling and/or workover rigs.

SUMMARY OF THE INVENTION

The present invention comprises an apparatus for supporting tubular goods and wellbore tools that can be used to perform down-hole operations in oil and gas wells. The apparatus of the present invention requires minimal surface area (e.g., deck space) because it has a small foot-print. Further, the present invention has many features of conventional rigs, while permitting operations to be conducted on a rig-less basis.

The present invention generally comprises a robust hydraulic system, a top deck, a rotary motor (thereby eliminating the need for a power swivel in many applications), a pipe break mounted on a top deck, and optional pipe tongs. The apparatus of the present invention can be used to jack and remove pipe (including, without limitation, casing), and can also be used to manipulate tubular goods into and out of a well.

Although the apparatus of the present invention can be used in many different applications, it is to be observed that it can be beneficially employed in connection with milling casing and/or other pipe, plugging and abandoning operations and/or recompletion/workover projects. The apparatus of the present invention is safe and efficient with a high level of performance and ease of operation.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT

The present invention comprises an apparatus for supporting tubular goods and wellbore equipment that can be used to perform down-hole operations in oil and gas wells. The support apparatus of the present invention has many features of conventional rigs and can be used to perform many of the same tasks as conventional rigs. However, the apparatus of the present invention has a beneficially small foot-print and, thus, requires minimal surface area (e.g., deck space).

Additionally, the support apparatus of the present invention generally includes a robust hydraulic system, a secondary (top) deck, a rotary motor (thereby eliminating the need for a power swivel in many applications), at least one pipe break mounted on a top deck, and pipe tongs for connecting and disconnecting threaded pipe. The apparatus of the present invention can be used to jack and remove pipe (including, without limitation, casing), and can also be used to move tubular goods into and out of a well.

Although the support apparatus of the present invention can be used in many different applications, it is to be observed that it can be beneficially employed in connection with milling of casing and/or other pipe, plugging and abandoning operations and/or recompletion/workover projects. Moreover, the support apparatus of the present invention is safe and efficient, can be certified with regulatory authorities, and provides a high level of performance and ease of operation.

Figure 1:
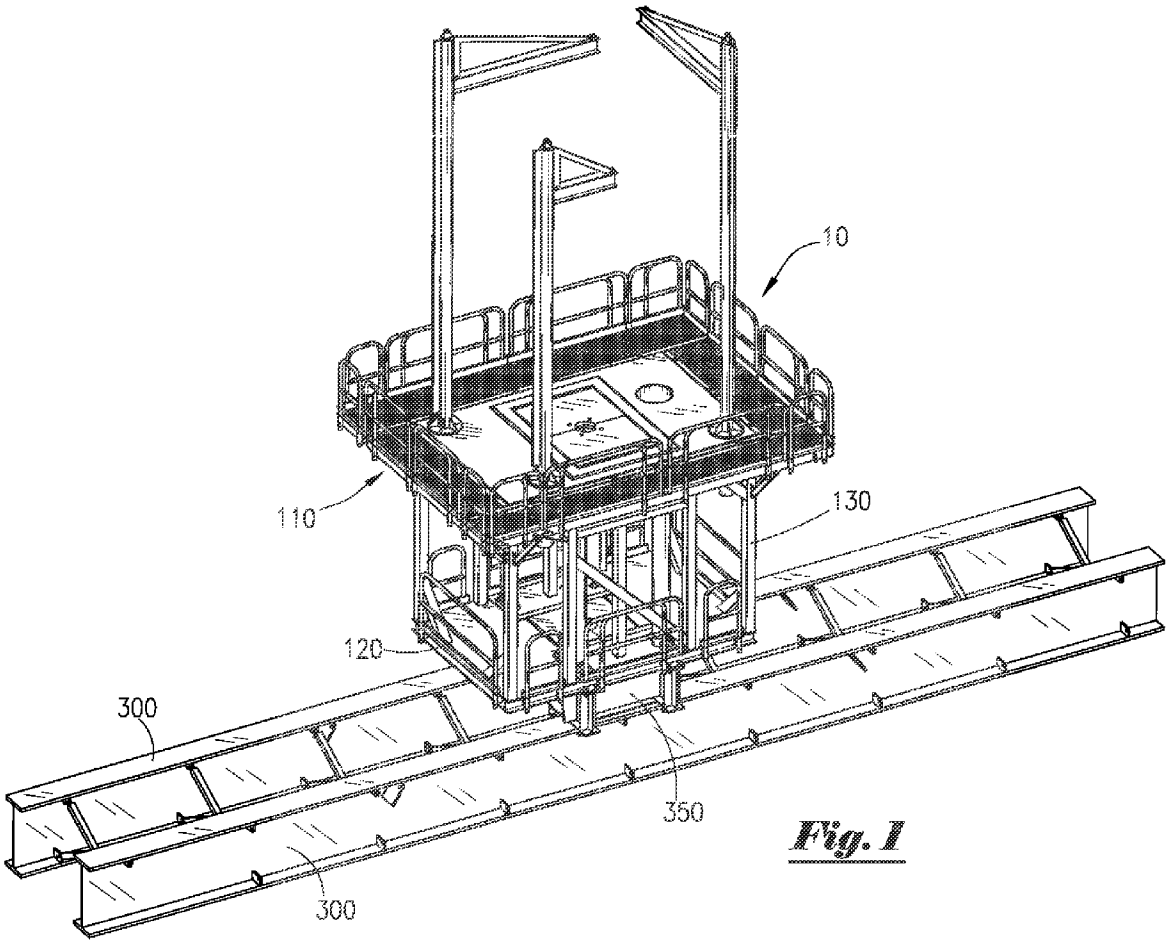
FIG. 1 depicts a side perspective view of the support apparatus of the present invention.

Referring to the drawings, FIG. 1 depicts a side perspective view of support apparatus 10 of the present invention disposed on support girders 300. In a preferred embodiment, support apparatus 10 comprises platform assembly 100, including upper deck assembly 110, lower deck assembly 120 and framework support members 130. Extendable deck assembly 200 is beneficially disposed within platform assembly 100 as more fully described herein.

As depicted in FIG. 1, support apparatus 10 of the present invention is disposed on skid assembly 350 which, in turn, is slidably disposed on substantially parallel support girders 300. In this configuration, support girders 300 can be placed in a desired position, while skid assembly 350 can be moved along the length of said parallel support girders 300. In this manner, support apparatus 10 can be beneficially positioned in a desired location such as, for example, above a wellhead or other work site including, without limitation, on an offshore platform or similar facility. It is also to be observed that support apparatus 10 of the present invention can be utilized without parallel support girders 300 and/or skid assembly 350, such as in applications where space constraints or other conditions limit the use of said support girders 300 and/or skid assembly 350.

Figure 2:
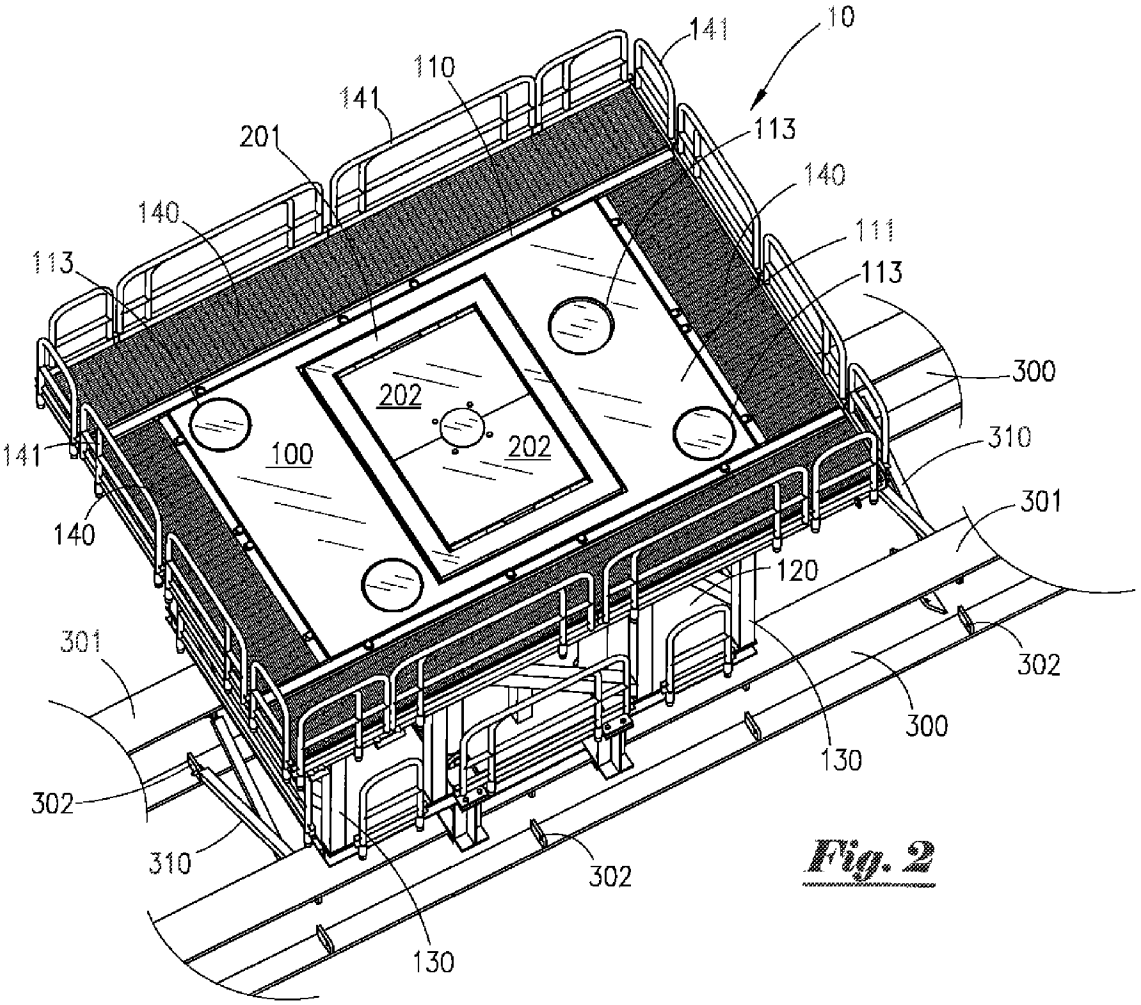
FIG. 2 depicts an overhead perspective view of the support apparatus of the present invention.

FIG. 2 depicts an overhead perspective view of support apparatus 10 of the present invention. As depicted in FIG. 2, support girders 300, having substantially flat upper surfaces 301 and sufficient strength characteristics, are positioned in substantially parallel configuration in a desired location. Brace bars 310 can be affixed to said girders, and used to brace said girders 300 and maintain a desired spacing between said girders 300. In a preferred embodiment, said brace bars 310 can be bolted or otherwise affixed to pad eyes 302 on support girders 300. Platform assembly 100 is disposed above substantially rectangular skid assembly 50, which is itself slidably disposed on upper surfaces 301 of support girders 300. Platform assembly 100 can be positioned relative to support girders 300 by moving skid assembly 350 along the longitudinal axis of said support girders 300.

In the preferred embodiment, support apparatus 10 generally comprises platform assembly 100, including upper deck assembly 110, lower deck assembly 120 and framework support members 130. In a preferred embodiment, upper deck 110 defines a substantially flat upper work surface 111 having central opening 112. Extendable deck assembly 200 is beneficially disposed within platform assembly 100, and aligned with said central opening 112 in upper deck assembly 110. Extendable deck assembly 200 has upper deck 201 having a substantially flat upper surface, and doors 202 connected to said upper deck 201 with hinges 203. Said doors 202 can include mating notches 202*a* that cooperatively form a hole extending through said doors 202 when in a closed position. Additionally, upper deck 110 can include at least one hole 113 extending therethrough.

Deck enlargement members 140 can be attached to upper deck assembly 110. In the preferred embodiment, said deck enlargement members 140 include grating or other lightweight material, and are affixed to all sides of upper deck assembly 110 in a cantilever manner discussed in more detail herein. Safety rails 141 extend substantially around the entire outer perimeter of said deck enlargement members 140. Said deck enlargement members 140 provide additional work space for personnel working on support apparatus 10 including, without limitation, on upper work surface 111 of upper deck assembly 110.

Figure 3:
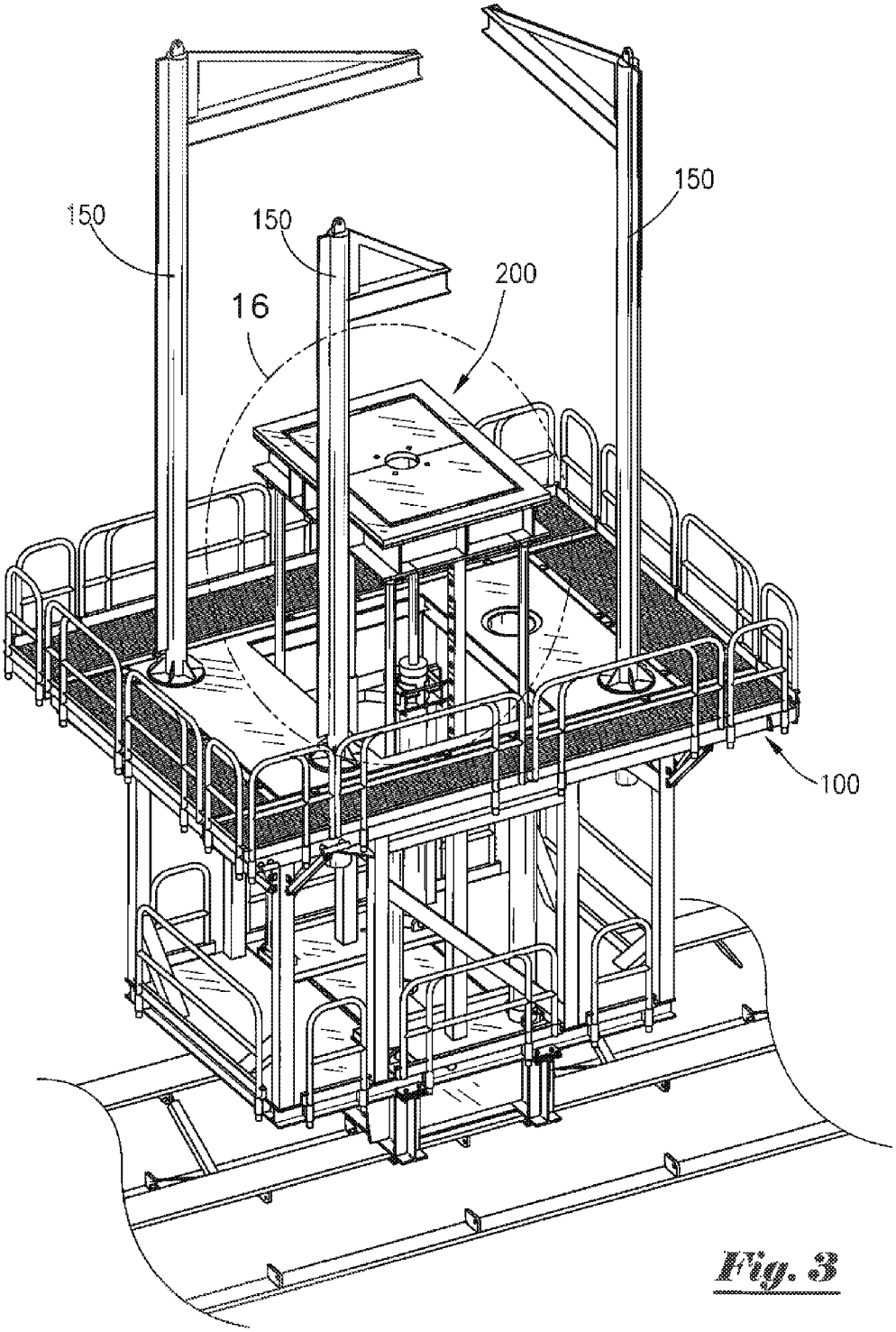
FIG. 3 depicts a side perspective view of the support apparatus of the present invention with an extendable deck assembly in an extended position.

FIG. 3 depicts a side perspective view of support apparatus 10 of the present invention with extendable deck assembly 200 in an extended position. As depicted in FIG. 3, extendable deck assembly 200 can be used to pull items including, without limitation, cut casing or other tubular goods from a wellbore situated below said support apparatus 10. Jib poles 150 are disposed within holes 113 extending through upper deck 110. Each such jib pole 150 is generally capable of rotating about its longitudinal axis, and can be used to support equipment (such as, for example, pipe tongs) in a beneficial work position above upper deck 110.

Figure 4:
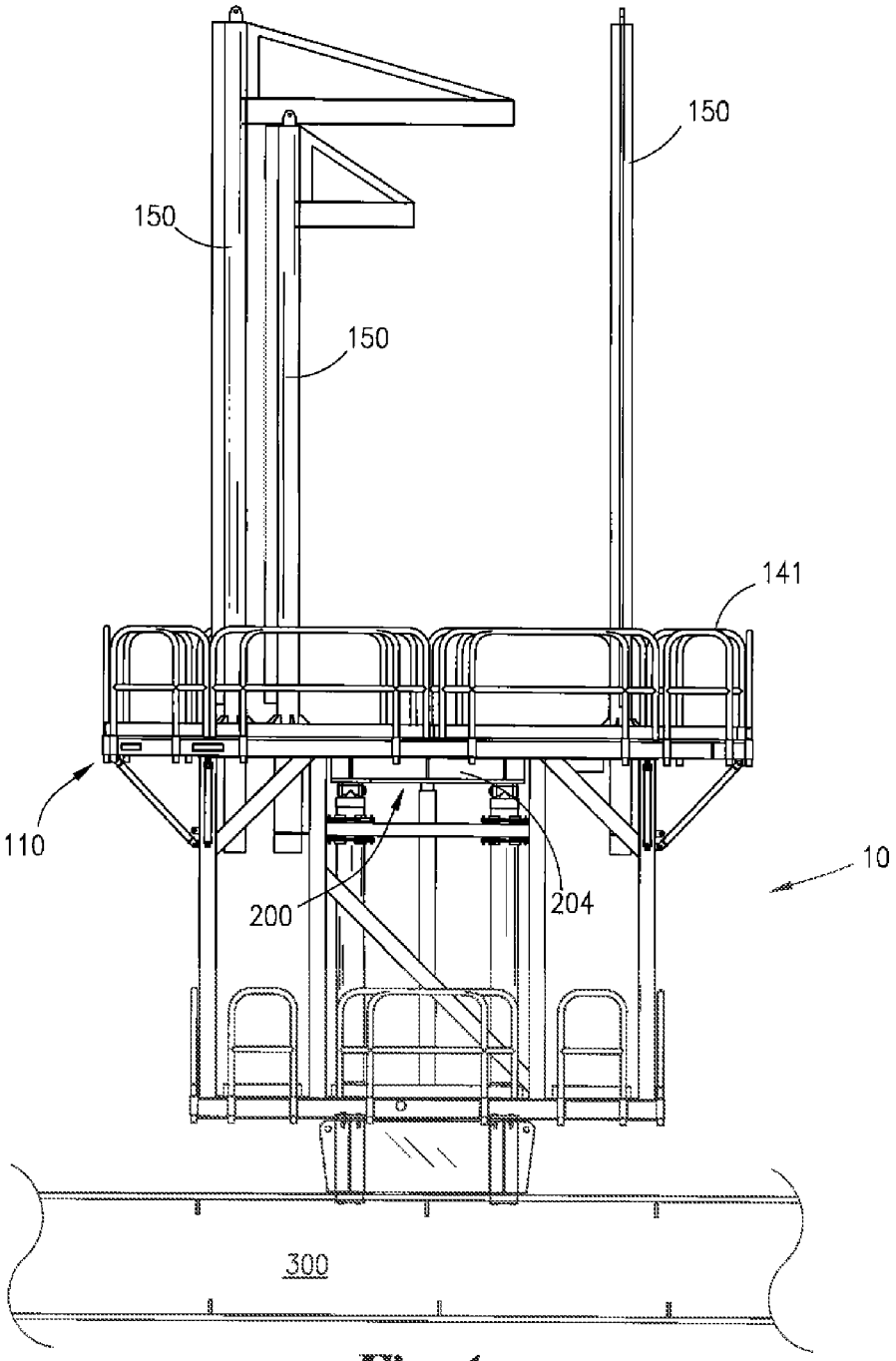
FIG. 4 depicts a side view of the support apparatus of the present invention with the extendable deck assembly in a retracted position.
Figure 5:
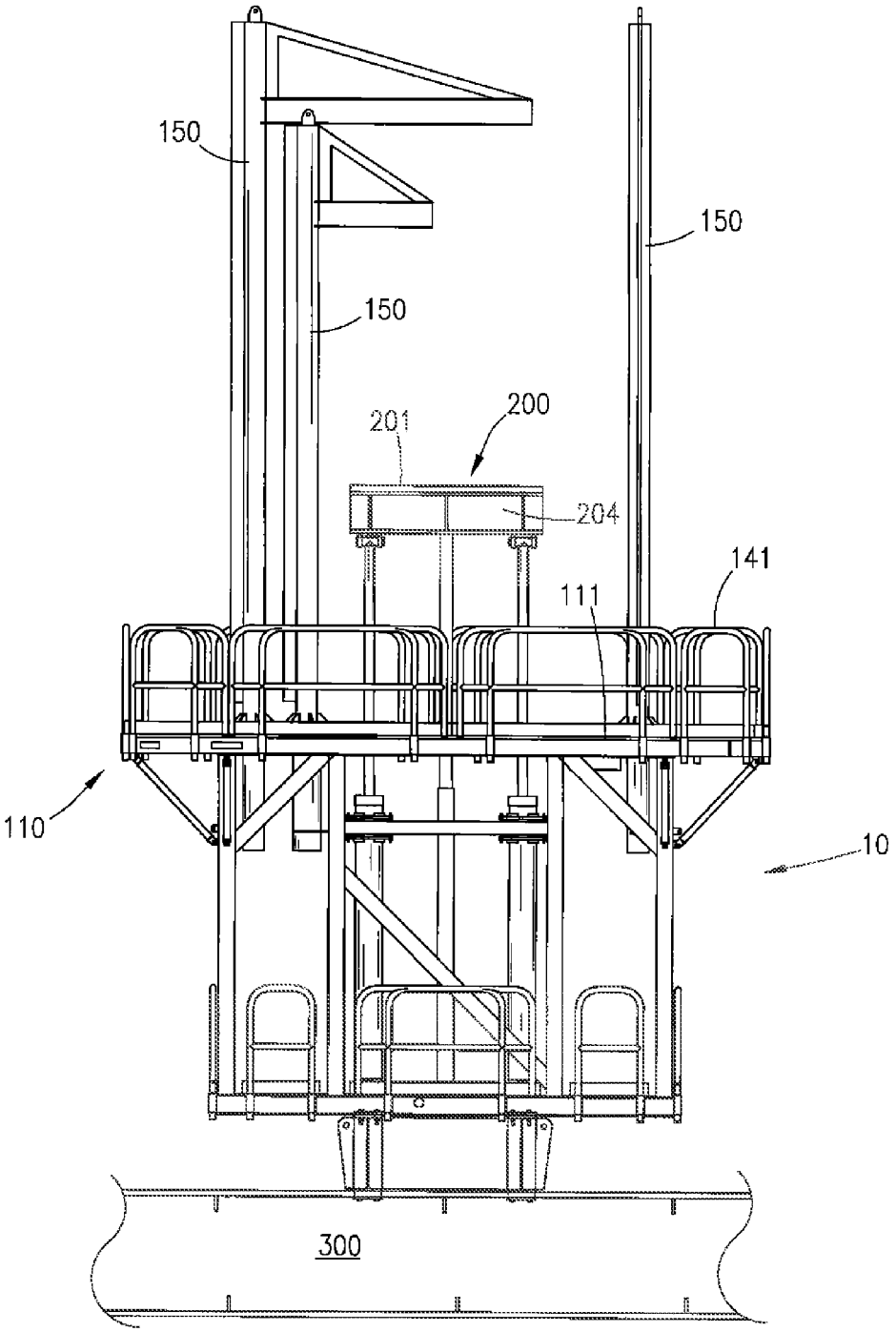
FIG. 5 depicts a side view of the support apparatus of the present invention with an extendable deck assembly in an extended position.

FIG. 4 depicts a side view of support apparatus 10 of the present invention with extendable deck assembly 200 in a retracted position, while FIG. 5 depicts a side view of support apparatus 10 of the present invention with said extendable deck assembly 200 in an extended position. As depicted in FIG. 4, upper surface 201 of extendable deck assembly 200 is substantially even with upper surface 111 of upper deck assembly 110. As depicted in FIG. 5, upper surface 201 of extendable deck assembly 200 is extended above upper surface 111 of upper deck assembly 110.

Figure 9:
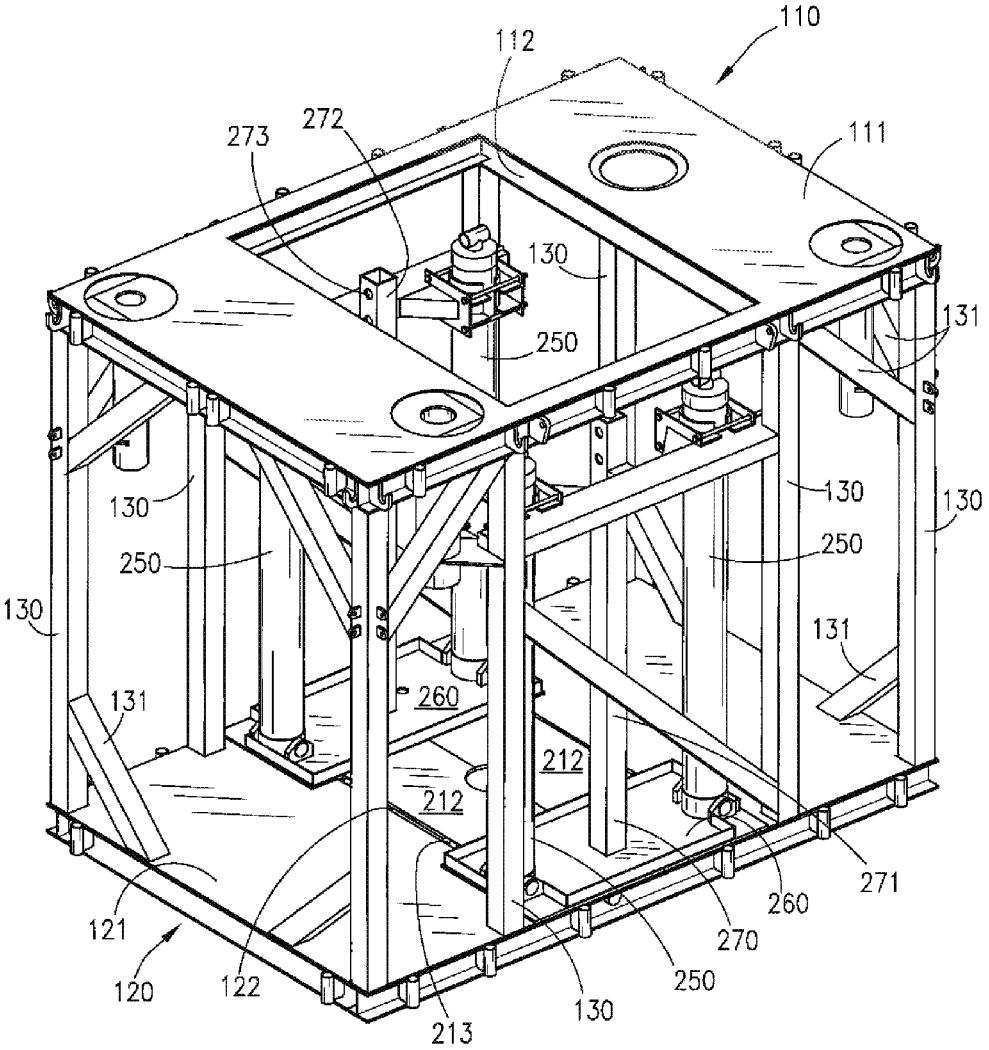
FIG. 9 depicts a side perspective view of certain components of support apparatus of the present invention.

Referring to FIG. 9, a side perspective view of a portion of platform assembly 100 of the present invention is depicted. Platform assembly 100 includes upper deck assembly 110, lower deck assembly 120 and framework support members 130. Support members 130 provide a structural framework for connecting and supporting upper deck assembly 110 and lower deck assembly 120, and can include corner support bracing members 131. Upper deck assembly 110 has substantially flat upper work surface 111 having central opening 112.

Lower deck assembly 120 has substantially flat upper work surface 121 defining central opening 122. In the preferred embodiment, central opening 122 of lower deck assembly 120 is substantially aligned with central opening 112 of upper deck assembly 110. Doors 212 are hingeably connected to lower deck assembly 120 using hinges 213. Said doors 212 can include mating notches that cooperatively form a hole extending through said doors 212 when said doors are in a closed position. In the preferred embodiment, said hole formed in lower doors 212 is beneficially substantially aligned with the hole formed in cooperating upper doors 202 (not shown in FIG. 9).

Still referring to FIG. 9, a plurality of hydraulic cylinders 250 are mounted to anchor plates 260 on lower deck 120. Further, telescoping locking assemblies 270 are mounted to anchor plates 260. In the preferred embodiment, each of said telescoping locking assemblies 270 comprise an elongate inner member 272, telescopically and slidably disposed within an outer sleeve member 271. Elongate inner members 272 are beneficially substantially hollow, and include a plurality of transverse bores 273 extending through at least one side of said inner members 272. In the preferred embodiment, substantially planar upper deck assembly 110 and lower deck assembly 120 are oriented substantially parallel to each other, while hydraulic cylinders 250 and elongate locking assemblies 270 are oriented substantially perpendicular to said upper and lower deck assemblies.

Figure 10:
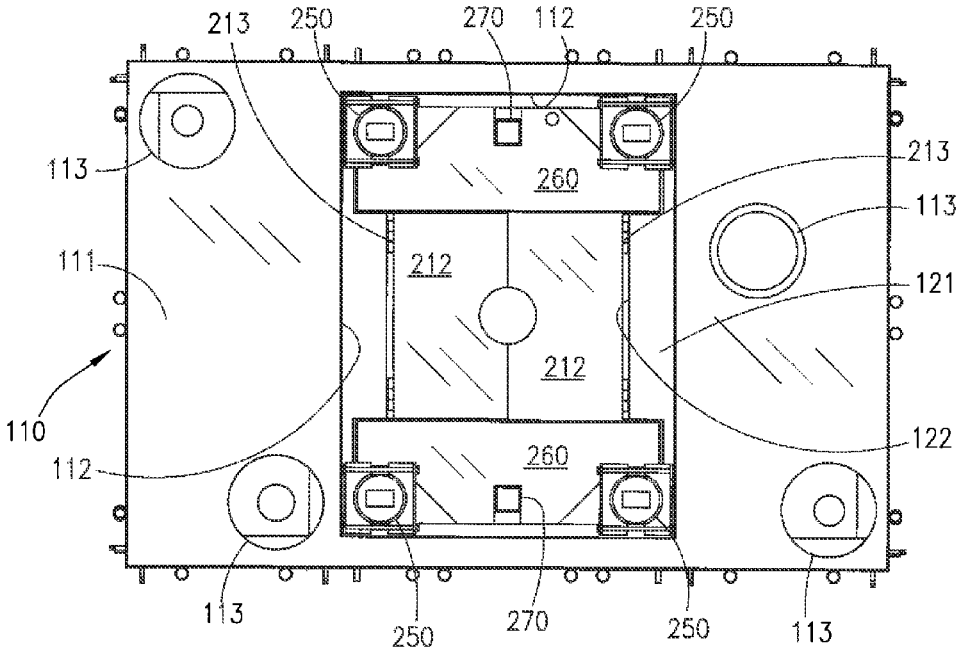
FIG. 10 depicts an overhead view of the components of support apparatus depicted in FIG. 9.
Figure 11:
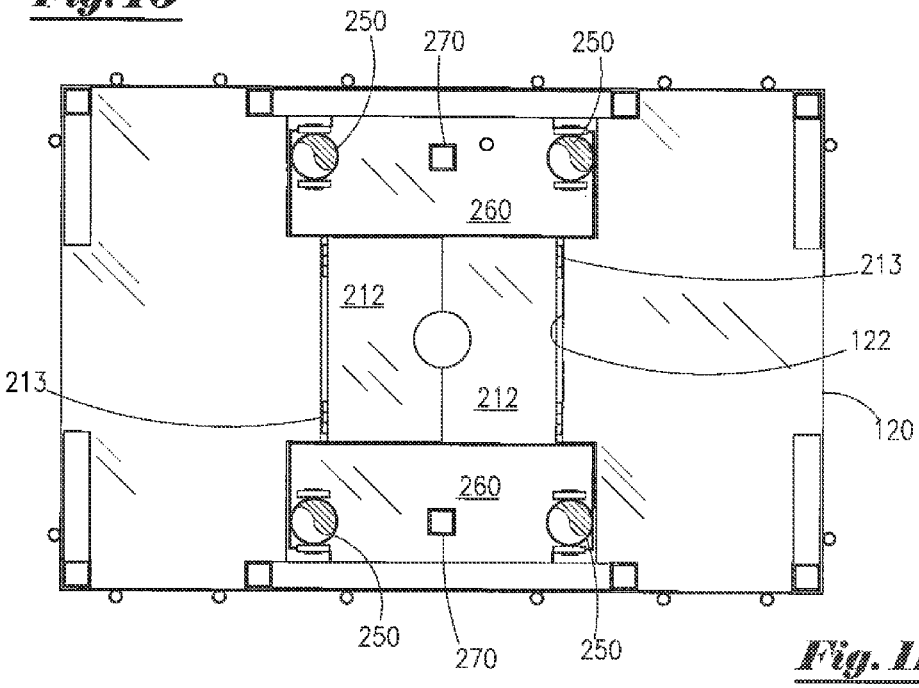
FIG. 11 depicts a bottom view of the components of support apparatus depicted in FIG. 9.

FIG. 10 depicts an overhead view of the components of support apparatus 10 depicted in FIG. 9, while FIG. 11 depicts a bottom view of the components of support apparatus 10 depicted in FIG. 9. Referring to FIG. 10, upper deck assembly 110 comprises a substantially flat upper work surface 111 having central opening 112. A plurality of holes 113 extend through said upper deck assembly 110.

A portion of lower deck assembly 120, having central opening 122, is visible through opening 112 in upper deck assembly 110. Central opening 122 of lower deck assembly 120 is substantially aligned with central opening 112 of upper deck assembly 110. Doors 212 are connected to said lower deck assembly 120 with hinges 213. Still referring to FIG. 10, a plurality of hydraulic cylinders 250 and telescoping locking members 270 are mounted to anchor plates 260 on lower deck 120, with said hydraulic cylinders 250 and telescoping locking members 270 oriented substantially normal to decks 110 and 120.

Referring to FIG. 11, lower deck 120 has central opening 122. Doors 212 are connected to said lower deck assembly 120 with hinges 213. Still referring to FIG. 11, the bases of hydraulic cylinders 250 are mounted to anchor plates 260 on lower deck 120, while the bases of telescoping locking members 270 are likewise mounted to anchor plates 260.

Figure 12:
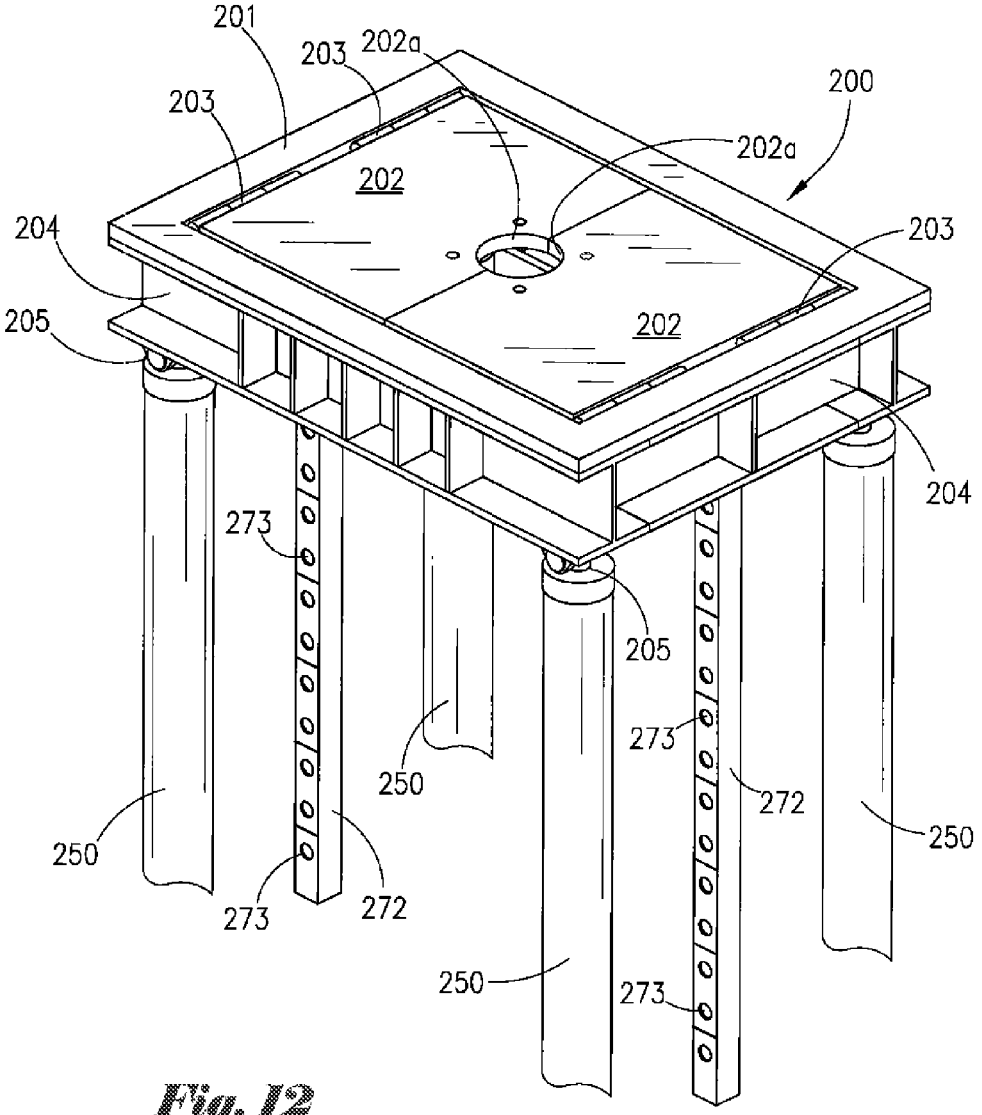
FIG. 12 depicts a side perspective view of extendable deck assembly of the present invention.

FIG. 12 depicts a side perspective view of extendable deck assembly 200 of the present invention. Extendable deck assembly 200 generally comprises frame members 204 that cooperatively form a substantially rectangular table-like structure having substantially flat upper surface 201. Doors 202 are connected to said frame members 204 with hinges 203. Said doors 202 can include mating notches **202*a* that cooperatively form a hole extending through said doors 202** when in a closed position.

In the preferred embodiment, hydraulic cylinders 250 are joined at their upper extent to frame members 204 of extendable deck assembly 200 using bracket members 205. Elongate inner members 272 of telescoping locking members 270 are likewise affixed to frame members 204 of deck assembly 200. In the preferred embodiment, inner members 272 are beneficially substantially hollow, and include a plurality of transverse bores 273 extending through at least one side of each of said inner members 272.

Figure 13:
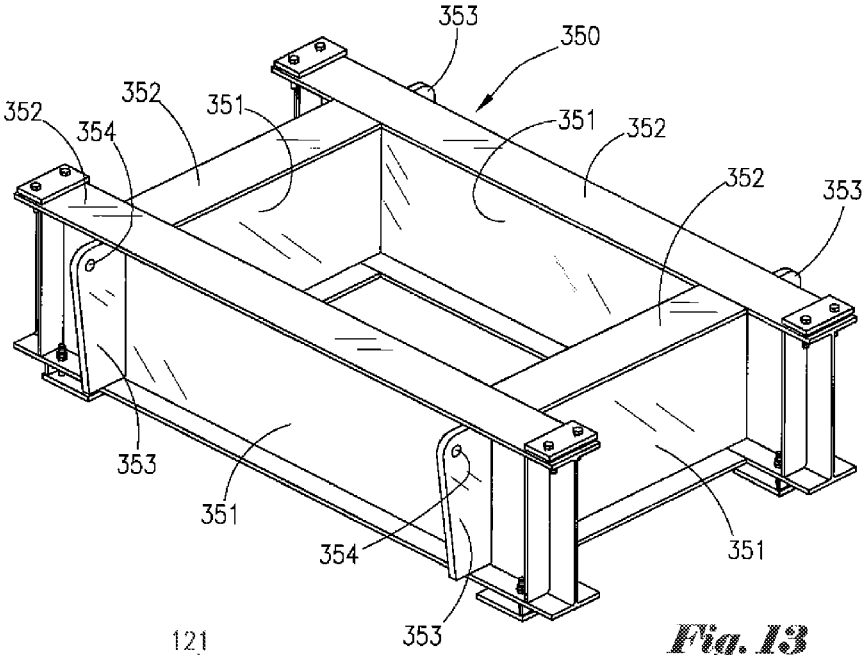
FIG. 13 depicts a perspective view of skid assembly of the present invention.

FIG. 13 depicts a perspective view of skid assembly 350 of the present invention. In the preferred embodiment, said skid assembly 350 is formed by frame members 351 that are joined together in a substantially rectangular pattern. Said frame members 351 have substantially flat upper surfaces 352, and are configured so as to define a central opening within said substantially rectangular pattern. Said frame members 351 can comprise I-beams or other structural members having desired characteristics including, without limitation, strength and weight-bearing characteristics. Further, said frame members 351 can include optional pad eye members 353 having holes 354 for connecting to skid assembly 350.

Figure 14:
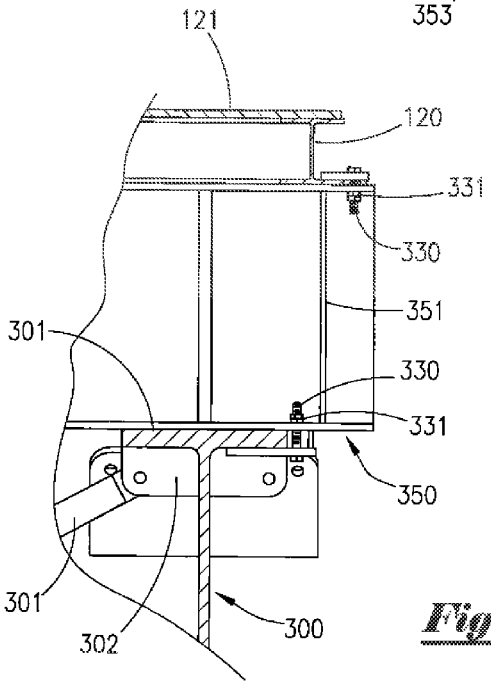
FIG. 14 depicts a sectional view of a portion of skid assembly disposed on support girders of the present invention.

FIG. 14 depicts a sectional end view of a portion of skid assembly 350 disposed on support girders 300 of the present invention. As depicted in FIG. 14, support girders 300, having substantially flat upper surfaces 301 and sufficient strength characteristics, are positioned in substantially parallel configuration in a desired location. Brace bars 310 can be used to brace said girders 300 and maintain a desired spacing between said girders 300. In a preferred embodiment, said brace bars 310 can be bolted or otherwise affixed to pad eyes 302 on support girders 300.

Lower deck assembly 120 of platform assembly 100, having substantially flat upper work surface 121, is mounted above substantially rectangular skid assembly 350. Although different methods can be used to join said members together, threaded bolts 330 and nuts 331 can be used. Skid assembly 350 is, in turn, disposed on upper surfaces 301 of support girders 300.

Figure 6:
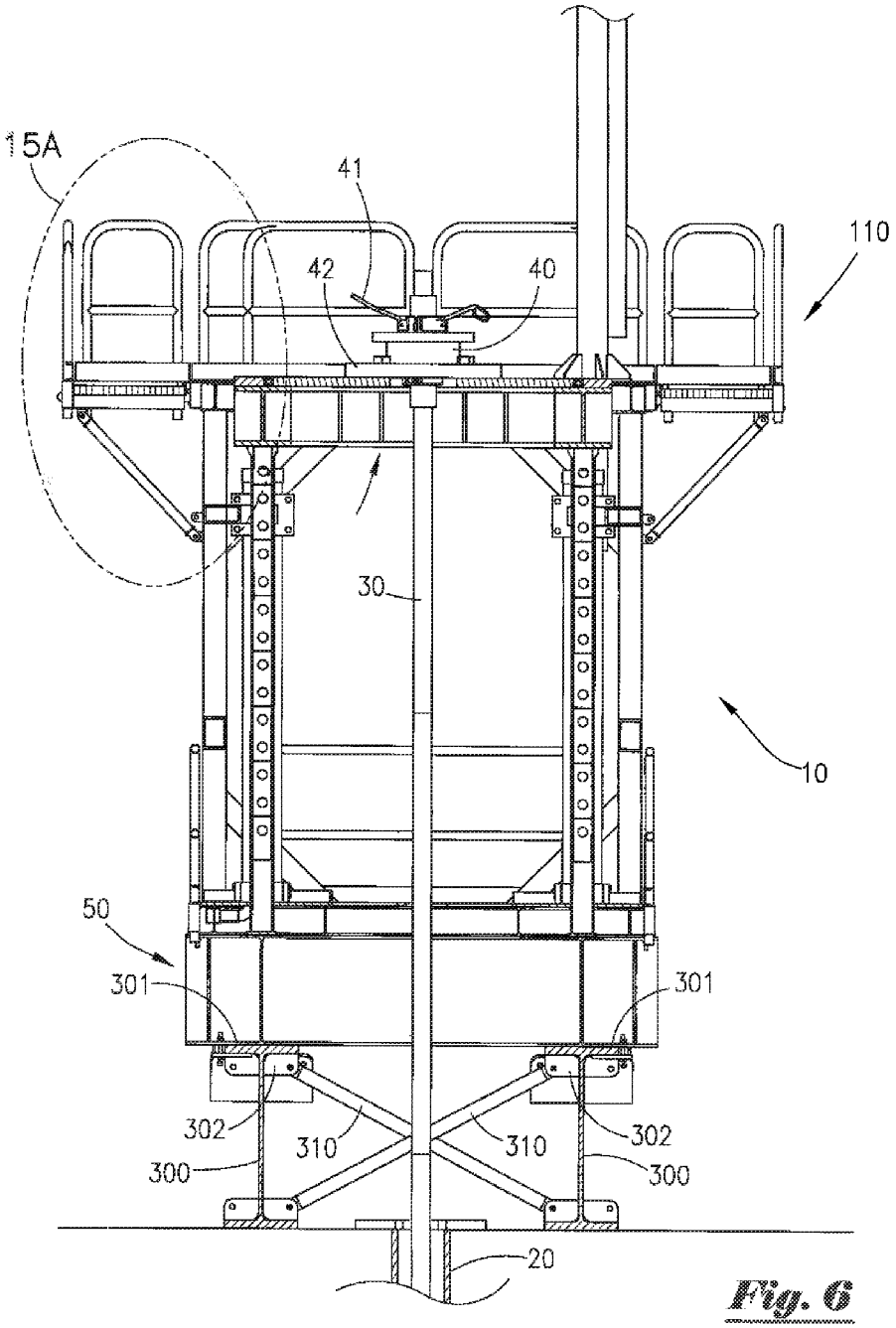
FIG. 6 depicts an end sectional view of the support apparatus of the present invention with an extendable deck assembly in a retracted position.
Figure 15A:
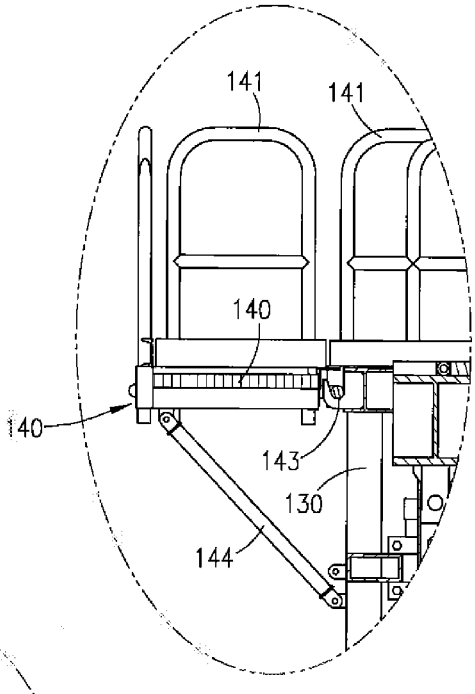
FIG. 15A depicts a side view of a portion the cantilever upper deck assembly highlighted in FIG. 6.

FIG. 15A depicts a side view of a removable cantilever upper deck enlargement member 140 of the present invention assembly highlighted in FIG. 6. In a preferred embodiment, deck enlargement member 140 defines a work surface formed by grating 142, and is pivotally attached to support member 130 using pivot pin 143. Support brace 144 can be provided to hold said deck enlargement member 140 in place and support loading (such as, for example, personnel or equipment) on said deck enlargement member 140. In the preferred embodiment, safety rails 141 extend around the outer perimeter of said deck enlargement members 140 to provide a safety barrier for personnel and equipment placed on such deck enlargement member 140. Said deck enlargement members 140 provided additional work space for personnel on upper deck assembly 110, and are relatively light due to use of grating 142.

Figure 15B:
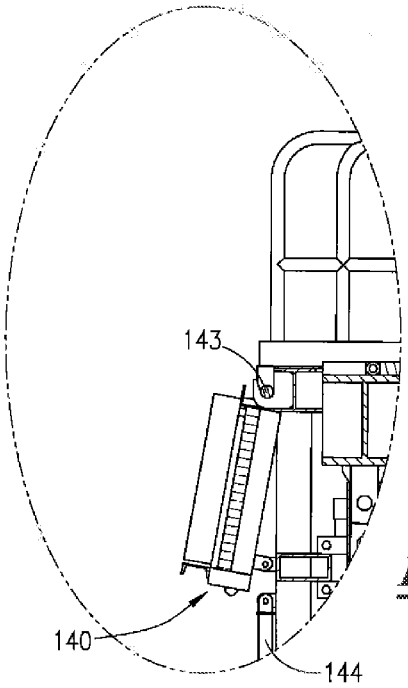
FIG. 15B depicts a side view of a portion the cantilever upper deck assembly shown in FIG. 15A, but in a collapsed position.

FIG. 15B depicts a side view of the upper deck enlargement assembly depicted in FIG. 15A, with deck enlargement member 140 in a collapsed position. As depicted in FIG. 15B, support brace 144 and safety rails 141 are removed, allowing deck enlargement member 140 to rotate about pivot pin 143, collapsing into the position depicted in FIG. 15B.

Figure 16:
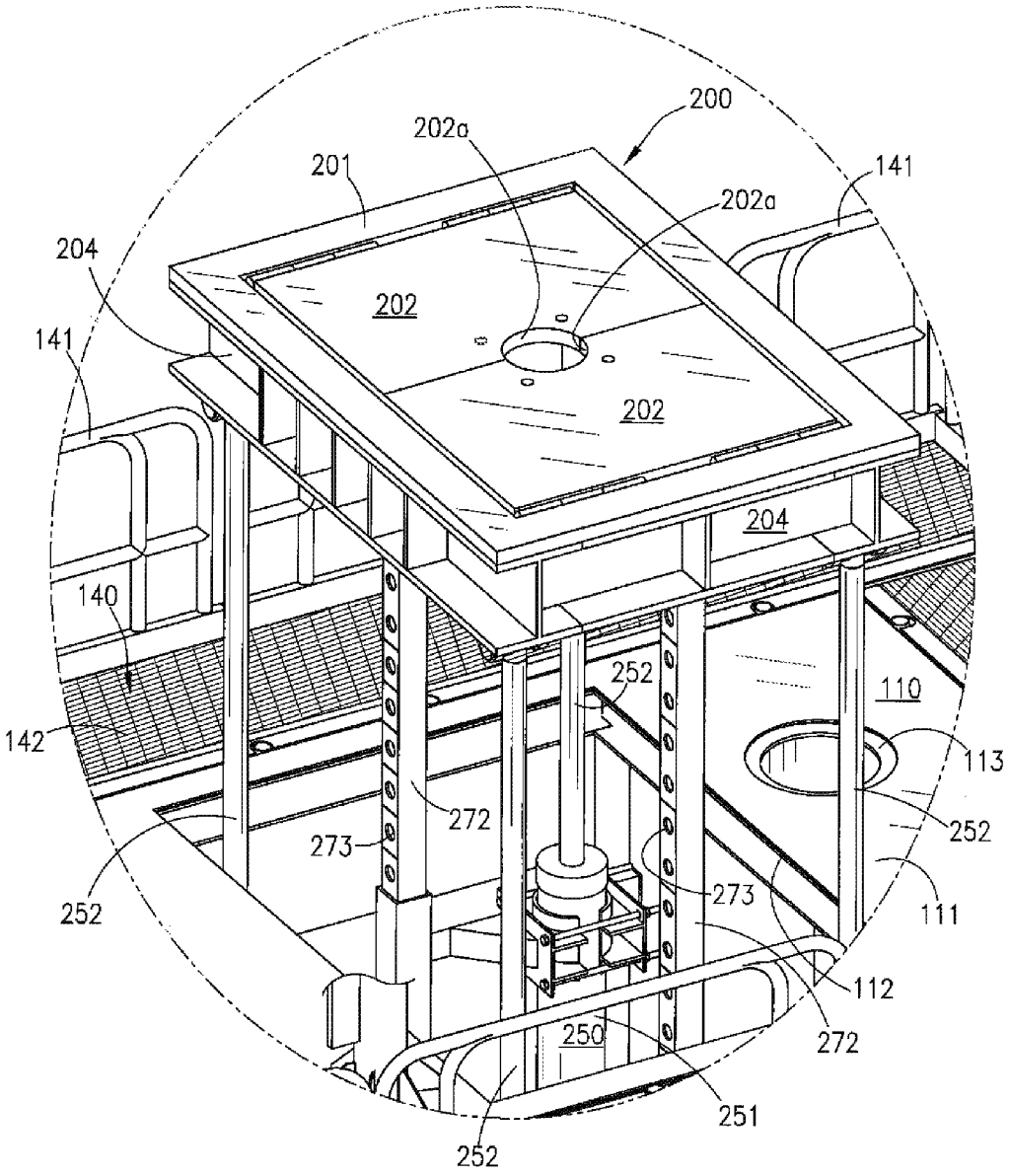
FIG. 16 depicts a side perspective view of the support apparatus of the present invention highlighted in FIG. 3.

FIG. 16 depicts a side perspective view of a highlighted portion of support apparatus 10 of the present invention depicted in FIG. 3. Support apparatus 10 includes upper deck assembly 110 having substantially flat upper work surface 111, central opening 112 and at least one hole 113 extending through upper deck assembly 110.

Extendable deck assembly 200 is aligned with said central opening 112 in upper deck assembly 110. Extendable deck assembly 200 has frame members 204 that together define upper surface 201, as well as doors 202 that are connected to frame members 204 with hinges 203. Said doors 202 can include mating notches 202*a* that cooperatively form a hole extending through said doors 202 when in a closed position.

Deck enlargement members 140 are attached to upper deck assembly 110. In the preferred embodiment, said deck enlargement members 140 include grating 142 and expand the usable work area of upper deck assembly 110. Safety rails 141 extend substantially around the entire outer perimeter of said deck enlargement members 140.

Hydraulic cylinders 250 each have cylinder barrel 251 and cylinder rod 252. The upper end of each cylinder rod 252 is joined to the table formed by frame members 204. Elongate inner members 272 of telescoping locking members 270 are likewise affixed to said frame members 204. Elongate inner members 272 are beneficially substantially hollow, and include a plurality of transverse bores 273 extending through at least one side of said inner members 272. As depicted in FIG. 16, hydraulic cylinders 250 are extended, thereby raising extendable upper deck 201 above upper deck 110.

FIG. 6 depicts an end sectional view of support apparatus 10 of the present invention with extendable deck assembly 200 in a substantially retracted position. Support girders 300, having substantially flat upper surfaces 301 and sufficient strength characteristics, are positioned in substantially parallel configuration in a desired location, such as over well 20. Brace bars 310 can be used to brace said girders 300 and maintain a desired spacing between said girders 300. In a preferred embodiment, said brace bars 310 can be bolted or otherwise affixed to pad eyes 302 on support girders 300. Platform assembly 100 is itself disposed above substantially rectangular skid assembly 50, which is disposed on upper surfaces 301 of support girders 300.

As depicted in FIG. 6, tubular workstring 30 is concentrically disposed within well 20. Slip bowl 40 is installed within extendable deck assembly 200. Slips 41 can be used with slip bowl 40 to grip tubular workstring 30. If desired, an optional rotary table 42 can also be included on extendable deck assembly 200. Support apparatus 10 of the present invention can be utilized to manipulate tubular workstring 30 in order to beneficially perform desired downhole work in well 20.

Figure 7:
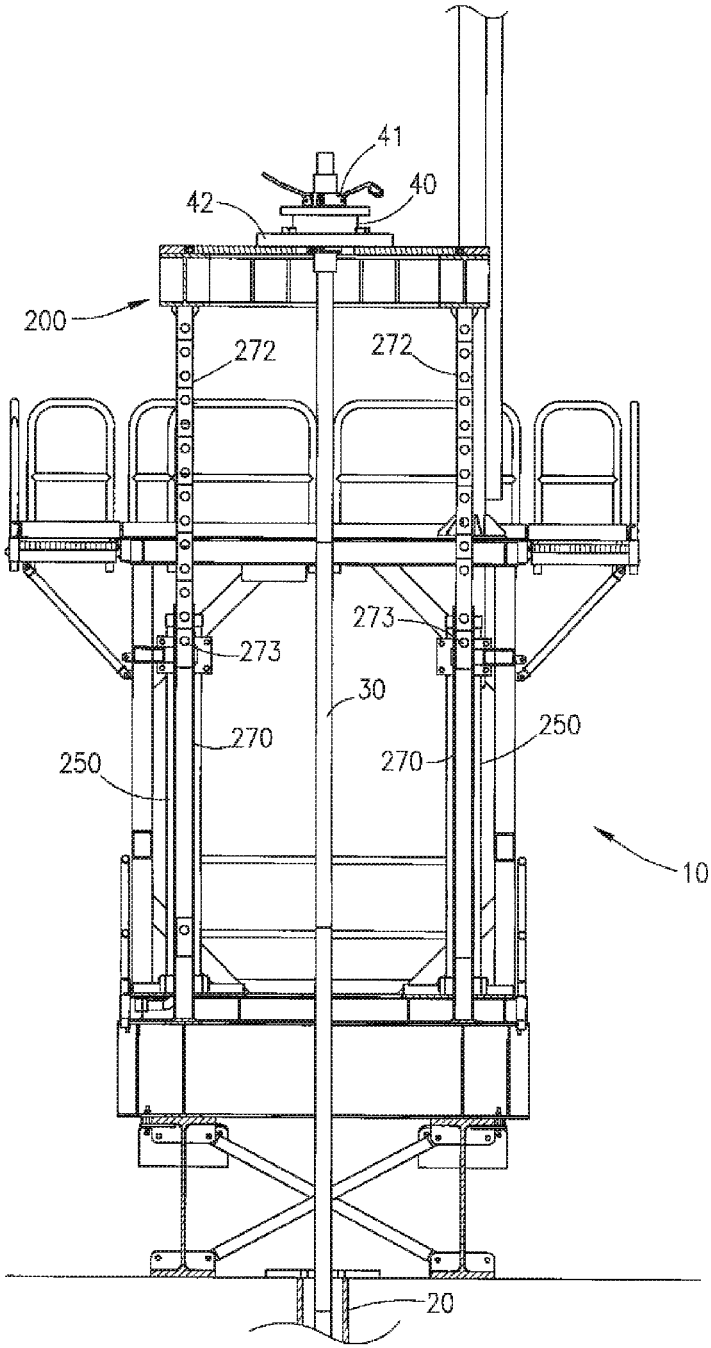
FIG. 7 depicts an end sectional view of the support apparatus of the present invention with an extendable deck assembly in an extended position.

FIG. 7 depicts a sectional end view of support apparatus 10 of the present invention with extendable deck assembly 200 in an extended position. As depicted in FIG. 7, said extendable deck assembly 200 can be used to lift said tubular workstring 30 (or other pipe) out of well 20 by actuating hydraulic cylinder assemblies 250. Further, once extended to a desired position, said extendable deck assembly 200 can be locked in place by inserting pins, bolts or other rigid members within the transverse bores of elongate locking members 270, thereby preventing said elongate locking members from telescoping closed.

Figure 8:
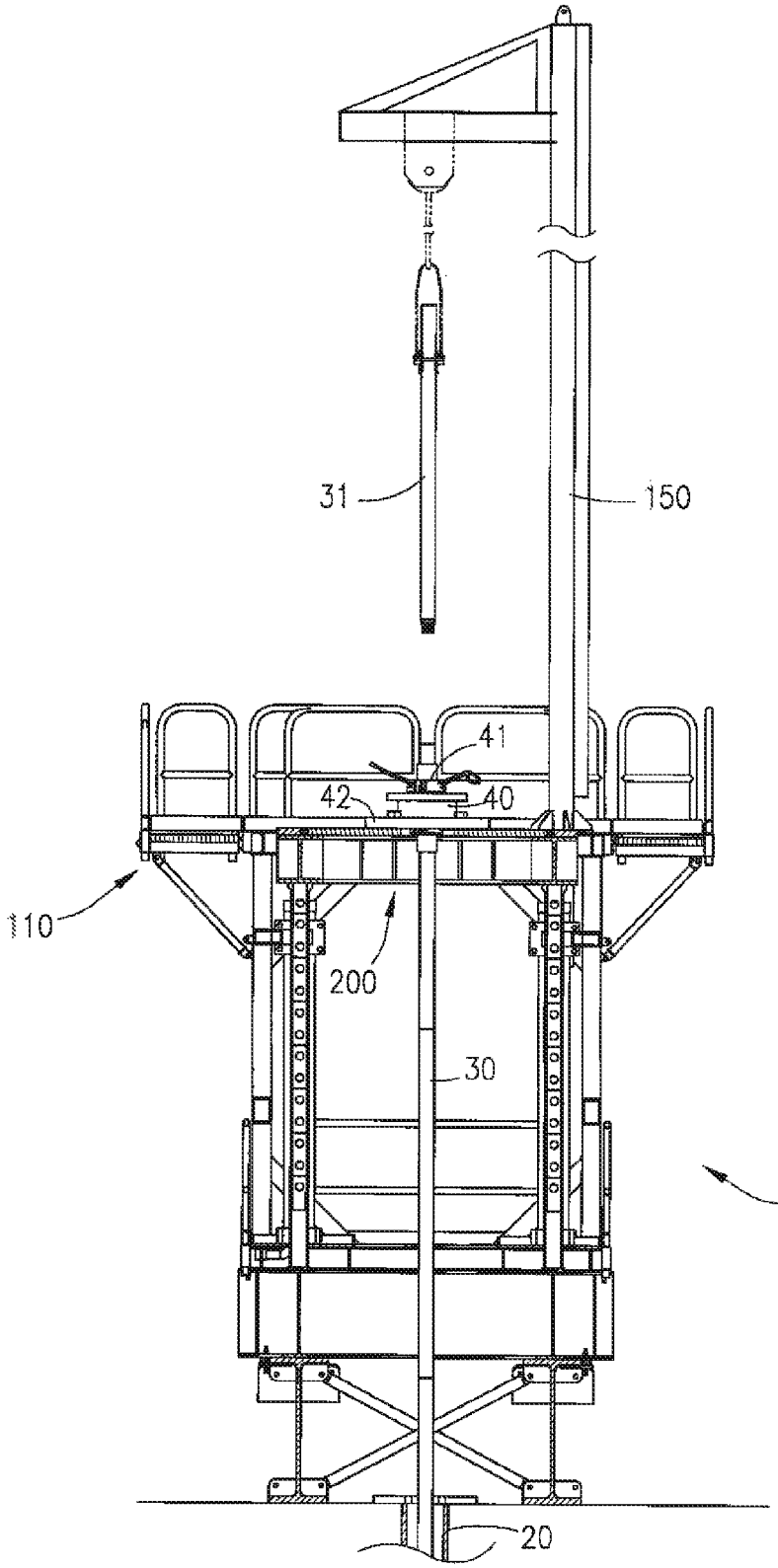
FIG. 8 depicts an end view of the support apparatus of the present invention with an extendable deck assembly in a retracted position.

FIG. 8 depicts an end sectional view of support apparatus 10 of the present invention with extendable deck assembly 200 in a substantially retracted position. Jib pole 150 can be used to support joint 31 of tubular workstring 30 and suspend said joint over well 20. It is to be observed that jib pole 150 can also be used to support power tongs used for connecting ("making-up") or disconnecting ("breaking") individual joints or other sections of work string 30.

In operation, support apparatus 10 of the present invention can be positioned over a well. As depicted in FIG. 8, in most instances support apparatus 10 will be oriented so that said well 20 is axially aligned with both central opening 122 of lower deck assembly 120, as well as central opening 112 of upper deck assembly 110. In this manner, workstring 30 can extend through said aligned central openings 122 and 112, and into well 20.

Lower doors 212 can be opened when access to areas below said doors including, without limitation, well 20, is required. Additionally, one or both of said doors 212 can be closed (often for the safety of personnel working on support apparatus 10) such that workstring 30 can extend through mating notches of said doors 212. Similarly, upper doors 202 can be opened when access to areas below said doors is required. One or both of said doors 202 can be closed such that workstring 30 can extend through mating notches of said doors 202.

Still referring to FIG. 8, workstring 30 is depicted as being used to perform operations within well 20. In such instances, such workstring 30 can be inserted into a well 20 in a number of separate sections of substantially equal length called "joints", such as pipe joint 31. Such joints are typically screwed together or otherwise joined end-to-end in order to form a substantially continuous "string" of pipe that reaches downward into well 30. As the bottom or distal end of the pipe workstring 30 penetrates further into well 20, additional sections of pipe can added to the upper end of the workstring at support apparatus 10.

Jib poles 150 can be used to support such sections of pipe for purposes of adding or removing pipe to workstring 30. As noted above, said jib poles 150 can also be utilized to support tongs or other equipment commonly used in the process of connecting and disconnecting tubular strings. Said workstring 30 can be supported within well 20 by setting gripping slips 41 within slip bowl 40.

Referring to FIG. 7, workstring 30 can be supported within well 20 by setting gripping slips 41 within slip bowl 40. Once said workstring is gripped, extendable deck assembly 200 can be used to lift said tubular workstring 30 (or other pipe) out of well 20 by actuating and extending hydraulic cylinder assemblies 250. After said deck assembly 200 has been extended to a desired position, said extendable deck assembly 200 can be held locked in place by hydraulic cylinder assemblies 250, as well as by inserting a pin, bolt or other rigid member within transverse bores 273 of inner members 272 of elongate locking members 270 (thereby preventing said inner members 272 from telescopically retracting into outer sleeve members 273). Support apparatus 10 of the present invention can also be utilized to insert pipe into a well, such as well 20, using the longitudinal stroke of hydraulic cylinder assemblies 250 in a process that is substantially the reverse of the process described above.

If rotation of workstring 30 is required, optional rotary table 42 can be used to rotate workstring 30. In this manner, rotational torque can be transmitted through said workstring 30, and can reach downhole equipment conveyed on workstring 30 within well 20. Workstring 30 can also be axially reciprocated within well 20 using the stroke of hydraulic cylinder assemblies 250.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A support apparatus for performing operations on a well comprising:

a) a first elongate girder member having a substantially planar upper surface;

b) a second elongate girder member having a substantially planar upper work surface, wherein said first and second elongate girder members are oriented substantially parallel to each other and define a gap therebetween, and wherein said well is disposed in said gap;

c) a lower deck, slidably disposed on said first and second elongate girder members, having a substantially planar upper work surface adapted to support personnel and an opening extending through said lower deck, wherein said opening is at least partially aligned with said gap between said first and second elongate members;

d) an upper deck having a substantially planar upper surface adapted to support personnel and an opening extending through said upper deck;

e) at least one support member connecting said upper and lower decks, wherein said upper and lower decks are oriented substantially parallel to each other and define a substantially open space there between;

f) a table member aligned with the opening of said upper deck, said table member having an opening through said table member aligned with the opening of said lower deck;

g) at least one hydraulic cylinder having an upper end and a lower end, wherein said lower end is mounted on said lower deck, said upper end is connected to said table member, and wherein extension of said at least one hydraulic cylinder raises said table member within said opening extending through said upper deck; and h) a powered rotary disposed on said table member for applying torque to a pipe or other tubular member extending through said table, wherein said rotary does not comprise a power swivel.

2. The support apparatus of claim 1, further comprising at least one deck extension member detachably connected to said upper deck.

3. The support apparatus of claim 2, wherein said deck extension member comprises grating having a substantially planar upper surface, wherein the upper surface of said grating is substantially aligned with the upper surface of said upper deck.

4. The support apparatus of claim 1, further comprising at least one door aligned with said opening of said lower deck and hingeably connected to said lower deck.

5. The support apparatus of claim 1, further comprising at least one door aligned with said opening of said extendable table member and hingeably connected to said table member.

6. The support apparatus of claim 1, further comprising at least one elongate locking member comprising:

a) a substantially hollow sleeve member having a top and a bottom, wherein said bottom is connected to said lower deck and said top is open;

b) an elongate inner member, telescopically received within said sleeve member; and c) a plurality of transverse bores extending through said elongate inner member.

* * * * *